US009585209B2

(12) United States Patent
Esaki et al.

(10) Patent No.: US 9,585,209 B2
(45) Date of Patent: Feb. 28, 2017

(54) LIGHTING APPARATUS AND ILLUMINATING FIXTURE WITH THE SAME

(71) Applicant: Panasonic Corporation, Osaka (JP)

(72) Inventors: Sana Esaki, Osaka (JP); Akinori Hiramatu, Nara (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 805 days.

(21) Appl. No.: 13/670,670

(22) Filed: Nov. 7, 2012

(65) Prior Publication Data

US 2013/0141002 A1 Jun. 6, 2013

(30) Foreign Application Priority Data

Dec. 5, 2011 (JP) ..... 2011-265718

(51) Int. Cl.
*H05B 33/08* (2006.01)

(52) U.S. Cl.
CPC ..... *H05B 33/0815* (2013.01); *H05B 33/0803* (2013.01)

(58) Field of Classification Search
CPC . H05B 33/0815; H05B 37/02; H05B 37/0281; H05B 33/0803; H05B 33/0806; H05B 33/0839; H05B 33/0845; H05B 33/0881; H05B 33/0833; H05B 33/0842; H02M 1/4225; H02M 3/33515; Y02B 20/346
USPC ..... 315/307, 247, 294, 297, 291, 312, 360
See application file for complete search history.

(56) References Cited

U.S. PATENT DOCUMENTS

| | | | | |
|---|---|---|---|---|
| 4,598,198 | A * | 7/1986 | Fayfield | 250/205 |
| 6,160,355 | A * | 12/2000 | Yee | 315/200 A |
| 7,145,295 | B1 * | 12/2006 | Lee et al. | 315/291 |
| 7,295,176 | B2 * | 11/2007 | Yang | 345/82 |
| 7,928,670 | B2 * | 4/2011 | Chen et al. | 315/308 |
| 8,653,755 | B2 * | 2/2014 | Esaki | H05B 33/0815 315/186 |

(Continued)

FOREIGN PATENT DOCUMENTS

| | | |
|---|---|---|
| JP | 2005-294063 A | 10/2005 |
| WO | 01/58218 A1 | 8/2001 |

OTHER PUBLICATIONS

STMicroelectronics, L6562A Transition-mode PFC controller, Aug. 2007.*

*Primary Examiner* — Haissa Philogene
(74) *Attorney, Agent, or Firm* — Renner, Otto, Boisselle & Sklar, LLP.

(57) ABSTRACT

In a first control mode, a control circuit turns a switching element on and off at a predetermined oscillating frequency and an On time so that a current flows through inductor in continuous mode without a sleep interval. In a second control mode, control circuit fixes oscillating frequency of switching element and changes On time of switching element. In a third control mode, control circuit fixes On time of switching element and changes oscillating frequency of switching element. Second control mode and third control mode are allocated for at least two intervals of intervals into which a dimming range is divided. Control circuit selects first control mode to fully light a light source load, and then, if a dimming ratio is designated, control circuit selects one of second and third control modes according to the interval, to which the dimming ratio corresponds, to dim light source load.

8 Claims, 11 Drawing Sheets

(56) References Cited

U.S. PATENT DOCUMENTS

| | | | | |
|---|---|---|---|---|
| 8,872,437 | B2 * | 10/2014 | Esaki | H05B 37/02 315/224 |
| 9,295,115 | B2 * | 3/2016 | Esaki | H05B 33/0815 |
| 2001/0024112 | A1 * | 9/2001 | Jacobs et al. | 323/282 |
| 2004/0251854 | A1 * | 12/2004 | Matsuda et al. | 315/291 |
| 2009/0322234 | A1 * | 12/2009 | Chen et al. | 315/159 |
| 2010/0164400 | A1 * | 7/2010 | Adragna | 315/294 |
| 2010/0259177 | A1 * | 10/2010 | Mednik et al. | 315/185 R |

* cited by examiner

FIG. 2 A
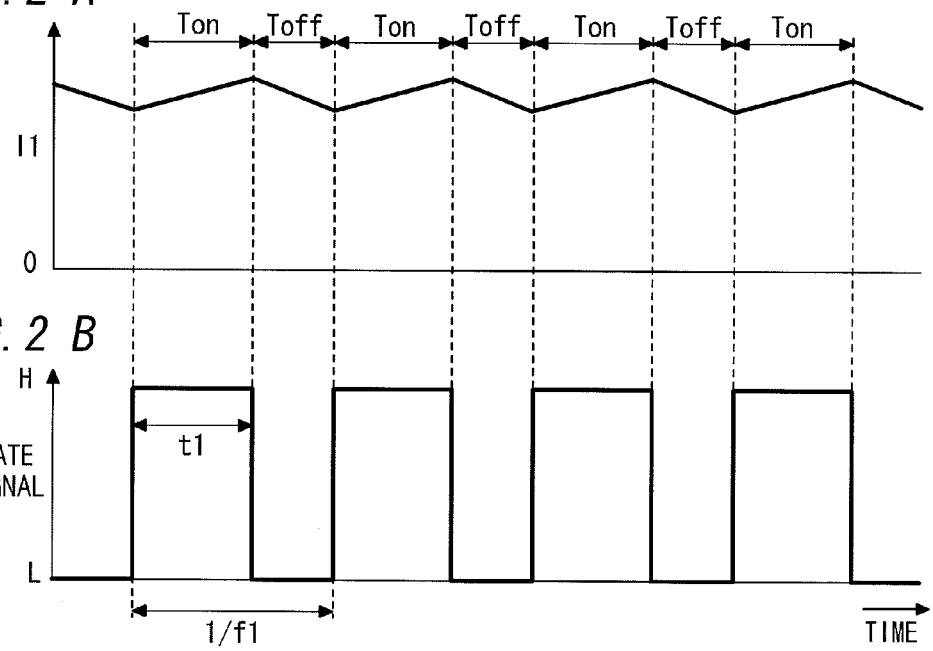
FIG. 2 B
FIG. 3 A
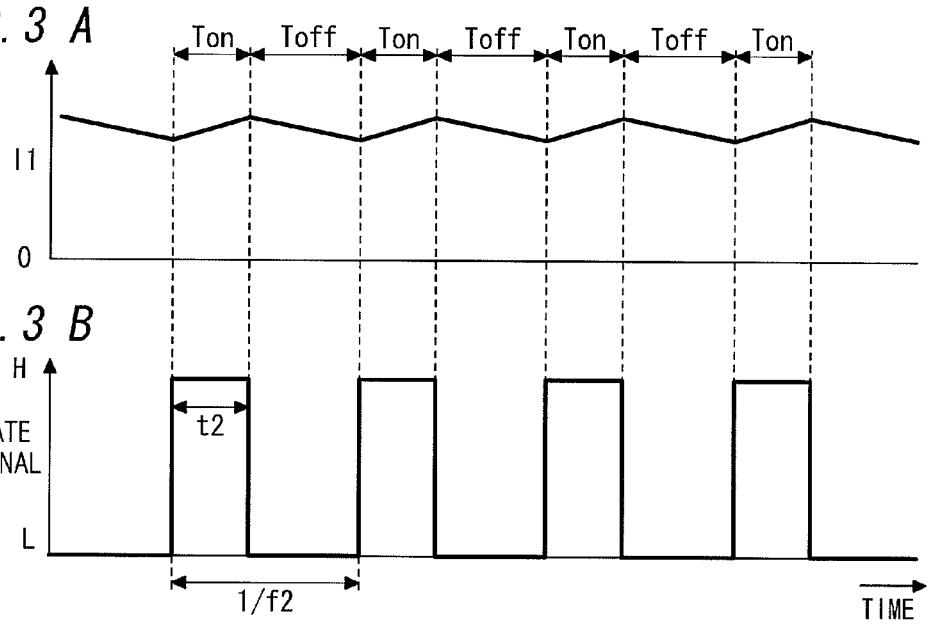
FIG. 3 B

LIGHTING APPARATUS AND ILLUMINATING FIXTURE WITH THE SAME

BACKGROUND OF THE INVENTION

Field of the Invention

The present invention relates to a lighting apparatus capable of dimming a semiconductor light emitting element and an illuminating fixture with the same.

Description of the Related Art

Recently, illuminating fixtures using a semiconductor light emitting element such as a light emitting diode (an LED), an organic electroluminescence (EL), and the like, as a light source have been proliferated. The type of illuminating fixture is provided with, for example, a lighting apparatus (an LED lighting apparatus) disclosed in Japanese Patent Application No. 2005-294063 (hereinafter referred to as a "Document 1").

The lighting apparatus in Document 1 is a self-excited type and does not have a dimming function. It is therefore impossible to dim the light source load.

Meanwhile, International Publication Number WO 01/58218 A1 (hereinafter referred to as a "Document 2") discloses that supply power to a light source load (an LED lighting module) is turned on and off at a burst frequency of 100 Hz or 120 Hz synchronized with a frequency (50 or 60 Hz) of an AC power supply (a main power supply voltage). The lighting apparatus (a power supply assembly) can control a length of a pulse in which the supply power to the light source load is in an On state, thereby performing a dimming control. However, a specific circuit configuration for dimming is not disclosed in Document 2.

However, as described in Document 2, in the lighting apparatus configured to perform dimming by controlling a pulse length (an On time), when a dimming ratio is small (dark), the On time in one period of the burst frequency is short, which may cause flicker. For this reason, in the lighting apparatus, a range of selectable dimming ratios is difficult to be set widely.

SUMMARY OF THE INVENTION

It is an object of the present invention to provide a lighting apparatus capable of widening a dimming range of a light source load with a relatively simple configuration and an illuminating fixture with the same.

According to an aspect of the present invention, a lighting apparatus, comprises: a switching element connected in series to a DC power supply and controlled to be turned on and off at high frequency; an inductor through which a current flows from the DC power supply when the switching element is turned on, said inductor being connected in series to the switching element; a diode that discharges electromagnetic energy stored in the inductor, when the switching element is turned on, to a light source load comprising a semiconductor light emitting element when the switching element is turned off; and a control circuit adapted to control an On and Off operation of the switching element, wherein the control circuit comprises first, second and third control modes as control modes of the switching element, and is adapted: in the first control mode, to turn the switching element on and off at a predetermined oscillating frequency and an On time so that a current flows through the inductor in continuous mode without a sleep interval; in the second control mode, to fix the oscillating frequency of the switching element and change the On time of the switching element; and in the third control mode, to fix the On time of the switching element and change the oscillating frequency of the switching element, wherein the second control mode and the third control mode are allocated for at least two intervals of intervals into which a dimming range between a minimum dimming ratio and a maximum dimming ratio is divided, and wherein the control circuit is adapted: if a full lighting mode is designated, to select the first control mode to fully light the light source load; and, if a dimming ratio is designated, to select one of the second and third control modes according to the interval, to which the dimming ratio corresponds, to dim the light source load at the dimming ratio.

According to another aspect of the present invention, the lighting apparatus further comprises: a current sensing unit for sensing the current flowing through the switching element; and a capacitor adapted to be charged by a driving signal of the switching element, wherein the control circuit is adapted: to turn the switching element off when the current sensed by the current sensing unit reaches a predetermined first value; and to turn the switching element on when a value of a voltage across the capacitor is a predetermined threshold value or less, and wherein the control circuit is adapted: to change the first value, thereby changing the On time of the switching element; and to change a predetermined second value determining a discharge speed of the capacitor, thereby changing the oscillating frequency of the switching element.

According to yet another aspect of the present invention, in the lighting apparatus, the control circuit is adapted to set at least one of the first and second values to be zero or less, thereby, stopping the On and Off operation of the switching element to turn the light source load off.

According to yet another aspect of the present invention, in the lighting apparatus, the control circuit is adapted to receive the dimming signal from outside to select a control mode of the switching element according to the dimming ratio determined by the dimming signal.

According to yet another aspect of the present invention, in the lighting apparatus, the control circuit is adapted to set the oscillating frequency of the switching element to be in a range of 1 kHz or more.

According to yet another aspect of the present invention, an illuminating fixture comprising: the lighting apparatus according to any one of above aspects; and the light source load adapted to be supplied with power from the lighting apparatus.

The present invention can widen the dimming range of the light source load with a relatively simple configuration.

BRIEF DESCRIPTION OF THE DRAWINGS

Preferred embodiments of the invention will now be described in further details. Other features and advantages of the present invention will become better understood with regard to the following detailed description and accompanying drawings where:

FIGS. 2A and 2B illustrate an operation of the lighting apparatus in a full lighting state according to the first embodiment;

FIGS. 3A and 3B illustrate an operation of the lighting apparatus in a first dimming state according to the first embodiment;

DETAILED DESCRIPTION OF EXEMPLARY EMBODIMENTS (First Embodiment)

Figure 1:
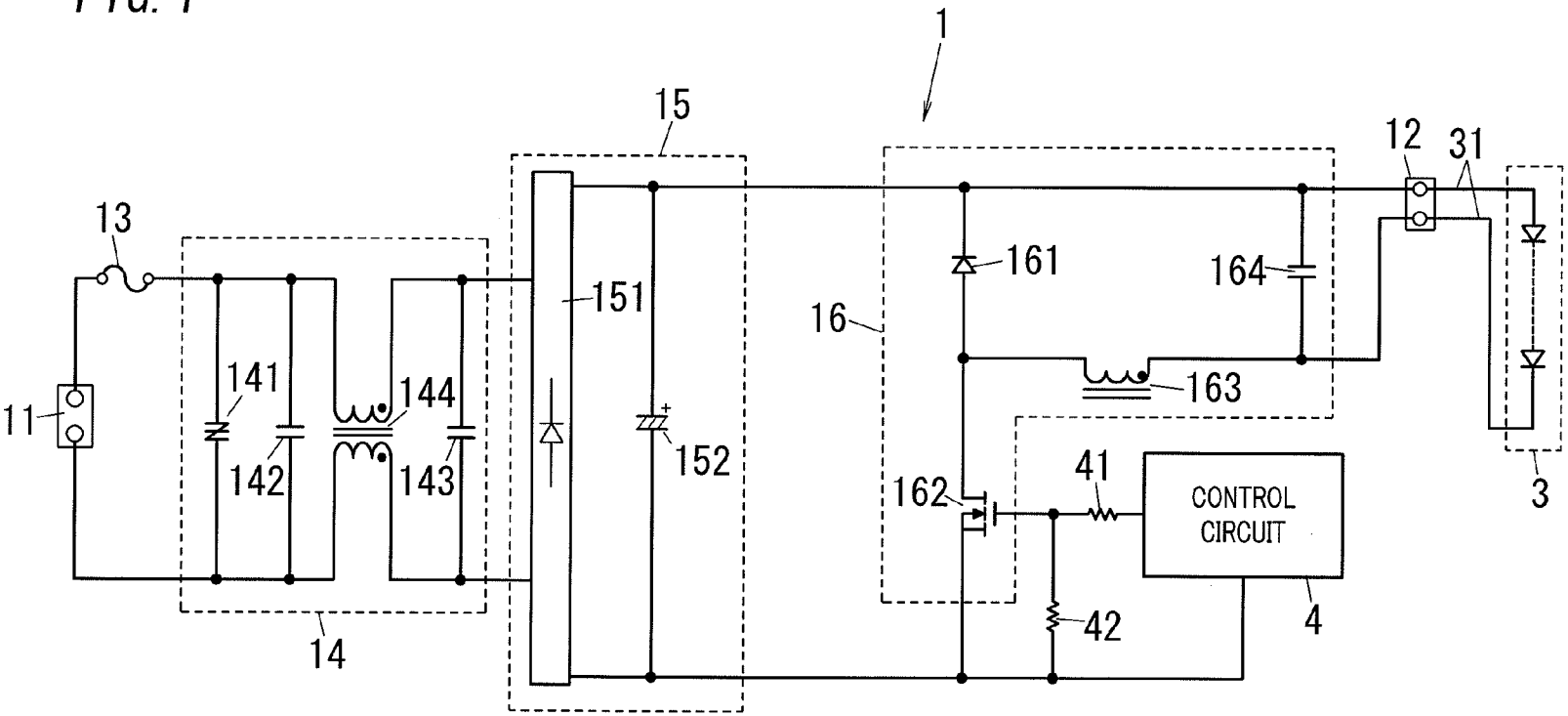
FIG. 1 is a circuit diagram showing the configuration of a lighting apparatus according to a first embodiment of the present invention.

As shown in FIG. 1, a lighting apparatus 1 according to an embodiment of the present invention includes a power supply connector 11 adapted to be connected to an AC power supply 2 (see FIG. 8) such as a commercial power supply, and an output connector 12 adapted to be connected to a light source load 3 comprising a semiconductor light emitting element such as a light emitting diode (LED) through lead wires 31. The light source load 3 is adapted to be lit by a DC current supplied from the lighting apparatus 1. The light source load 3 may be an LED module formed of a plurality of (for example, thirty) light emitting diodes connected in series, in parallel, or in series and parallel.

The lighting apparatus 1 includes: a DC power supply generation unit having a filter circuit 14 and a DC power supply circuit 15; a step-down chopper circuit (a buck converter) 16; and a control circuit 4, as main components. A basic configuration of the lighting apparatus 1 will be hereinafter described with reference to FIG. 1.

The power supply connector 11 is connected to the DC power supply circuit 15 through a current fuse 13 and the filter circuit 14. The filter circuit 14 includes: a surge voltage absorbing device 141 and a filter capacitor 142 connected in parallel with the power supply connector 11 through the current fuse 13; a filter capacitor 143; and a common mode choke coil 144, and is adapted to cut noise. The filter capacitor 143 is connected between input terminals of the DC power supply circuit 15 and the common mode choke coil 141 is inserted between the two filter capacitors 142 and 143.

Herein, the DC power supply circuit 15 is a rectified smoothing circuit including a full-wave rectifier 151 and a smoothing capacitor 152, but it is not limited thereto. For example, the DC power supply circuit 15 may be a power correction circuit (a power factor improving circuit) including a step-up chopper circuit. By the above configuration, the DC power supply generation unit including the filter circuit 14 and the DC power supply circuit 15 converts an AC voltage (100 V, 50 or 60 Hz) from a DC power supply 2 into a DC voltage (about 140 V) and outputs the converted DC voltage from the output terminals (both terminals of the smoothing capacitor 152) thereof. The output terminals (both terminals of the smoothing capacitor 152) of the DC power supply circuit 15 are connected to the step-down chopper circuit 16 and output terminals of the step-down chopper circuit 16 are connected to the output connector 12.

The step-down chopper circuit 16 includes: a diode (a regenerative diode) 161 and a switching element 162 connected in series to each other and connected between the output terminals of the DC power supply circuit (the DC power supply) 15; and an inductor 163 connected in series to the light source load 3 between both ends of the diode 161. In this configuration, the diode 161 is installed so that a cathode of the diode 161 is connected to an output terminal of a positive side of the DC power supply circuit 15. That is, the switching element 162 is arranged to be inserted between a serial circuit of the inductor 163 and the light source load 3 connected in parallel with the diode 161, and an output terminal of a negative side of the serial power supply circuit 15. A function of the diode 161 will be described below.

The step-down chopper circuit 16 also includes an output capacitor 164 (shown with a broken line in FIG. 1) between output terminals thereof (between both terminals of the output connector 12) and the output capacitor 164 is connected in parallel with the light source load 3 and inhibits a pulsation (a ripple) of the output to the light source load 3. However, the output capacitor 16 can be appropriately omitted.

The control circuit 4 includes a driver circuit 4A (see FIG. 6), and is adapted to turn on and off the switching element 162 of the step-down chopper circuit 16 at a high frequency. In an example of FIG. 1, the switching element 162 includes a metal oxide semiconductor field effect transistor (MOSFET) and the driver circuit 4A is adapted to supply a gate signal between a gate and a source of the switching element 162, thereby turning the switching element 162 on and off. More specifically, the driver circuit 4A outputs a gate signal (see FIG. 2B) having a rectangular wave form in which a high (H) level and a low (L) level are alternately repeated, and the switching element 162 is turned on when the gate signal is in a period of the H level and turned off when the gate signal is in a period of the L level. In the example of FIG. 1, an output terminal for the gate signal from the control circuit 4 is connected to the output terminal of a negative side of the DC power supply circuit 15 through a serial circuit of resistors 41 and 42 and a connection point of the two resistors 41 and 42 is connected to a gate terminal of the switching element 162.

However, the control circuit 4 has three modes, that is, a first control mode, a second control mode, and a third control mode as control modes of the switching element 162. The control circuit 4 is adapted to select the second control mode or the third control mode according to a dimming ratio designated from the outside, thereby dimming the light source load 3 based on the designated dimming ratio. Here, a dimming range between a minimum dimming ratio and a maximum dimming ratio is divided into a plurality of intervals, and the second control mode and the third control mode are previously allocated for at least two intervals of the divided intervals. In the embodiment, the minimum dimming ratio is 0%, and the maximum dimming ratio is 100%.

In the first control mode, the control circuit 4 is adapted to turn the switching element 162 on and off at a predetermined oscillating frequency (that is, a switching frequency of the switching element 162) and On time (an On time per one period) so that, as a continuous mode, a current (an electric current) continuously flows through the inductor 163 without a sleep interval. In the second control mode, the control circuit 4 is adapted to approximately fix the oscillating frequency of the switching element 162 within each of the aforementioned intervals and to change the On time of the switching element 162. Unlike the second control mode, in the third control mode, the control circuit 4 is adapted to approximately fix the On time of the switching element 162 within each of the intervals and to change the oscillating frequency of the switching element 162.

The control circuit 4 is adapted to select the first control mode to fully light the light source load 3, if a full lighting mode for fully lighting the light source load 3 is designated. Meanwhile, if a dimming mode for dimming the light source load 3 at a dimming ratio is designated, the control circuit 4 is adapted to select one of the second and third control modes according to an interval corresponding to the designated dimming ratio, thereby dimming the light source load 3 according to the designated dimming ratio. Here, in the second control mode, the oscillating frequency is approximately fixed within the interval for which the second control mode is allocated and therefore, a frequency as a preset value is previously allocated for the oscillating frequency fixed within the interval. In the third control mode, the On time is approximately fixed within the interval for which the third control mode is allocated and therefore, a time as a preset value is previously allocated for the On time fixed within the interval.

For example, when a dimming ratio of the interval corresponding to the second control mode is designated, the control circuit 4 selects the second control mode and approximately fixes the oscillating frequency to the preset value (the oscillating frequency) that is allocated to the interval and changes the On time to dim the light source load 3. On the other hand, when a dimming ratio of the interval corresponding to the third control mode is designated, the control circuit 4 selects the third control mode and approximately fixes the On time to the preset value (On time) that is allocated to the interval and changes the oscillating frequency to dim the light source load 3.

Next, an operation of the foregoing lighting apparatus 1 is described as being divided into a full lighting state in which the light source load 3 is fully lit and each of first to third dimming states in which the light source load 3 is dimmed. The first dimming state mentioned herein is a lighting state according to the second control mode. The second dimming state is a lighting state in which the third control mode is additionally selected from the first dimming state, and the third dimming state is a lighting state in which the second control mode is additionally selected from the second dimming state. That is, the lighting apparatus 1 is transferred to the first dimming state when the second control mode is selected from the full lighting state, transferred to the second dimming state when the third control mode is selected from the first dimming state, and transferred to the third dimming state when the second control mode is selected from the second dimming state. In other words, the first dimming state is a state in which only the second control mode is selected from the full lighting state, and the second dimming state is a state in which the third control mode in addition to the second control mode is selected from the full lighting state in a multi-stage type. The third dimming state is a state in which the third control mode in addition to the second control mode and the second control mode are selected from the full lighting state in a multi-stage type.

FIGS. 2A and 2B show an operation of the lighting apparatus 1 in the full lighting state. In FIGS. 2A and 2B, each horizontal axis represents time, and FIG. 2A shows a current I1 flowing through the inductor 163, and FIG. 2B shows a gate signal (a driving signal) applied to the gate terminal of the switching element 162 from the control circuit 4 (FIGS. 3A and 3B, FIGS. 4A and 4B, and FIGS. 5A and 5B are the same as FIGS. 2A and 2B). Further, in FIGS. 2A and 2B, an On interval (that is, a period in which a gate signal is the H level) in which the switching element 162 is turned on is represented by "Ton", and an Off interval (that is, a period in which the gate signal is the L level) in which the switching element 162 is turned off is represented by "Toff" (FIGS. 3A and 3B, FIGS. 4A and 4B, and FIGS. 5A and 5B are the same as FIGS. 2A and 2B).

In the On interval of the switching element 162 in the full lighting state, a current flows through a path of the DC power supply circuit 15, the light source load 3, the inductor 163, the switching element 162, and the DC power supply circuit 15 from the DC power supply circuit 15, and thus electromagnetic energy is stored in the inductor 163. Meanwhile, in the Off interval of the switching element 162, the electromagnetic energy stored in the inductor 163 is discharged and a current flows through a path of the inductor 163, the diode 161, the light source load 3, and the inductor 163.

Here, in the full lighting state (mode), the control circuit 4 turns the switching element 162 on and off at the predetermined oscillating frequency and On time (On time per one period) according to the first control mode. As shown in FIG. 2A, in the full lighting state, the lighting apparatus 1 is operated in a so-called continuous mode in which the switching element 162 is turned on again before the current I1 flowing through the inductor 163 becomes zero even if the switching element 162 is turned off. In this case, the oscillating frequency of the switching element 162 is f1 and the On time thereof is t1.

FIGS. 3A and 3B show an operation of the lighting apparatus 1 in the first dimming state.

In the first dimming state, the control circuit 4 mainly controls the On time of the switching element 162 so that an oscillating frequency f2 is approximately equal to the oscillating frequency f1 of the full lighting state. That is, the control circuit 4 changes only the On time of the switching element 162 so as to be short while fixing the oscillating frequency of the switching element 162 from the full lighting state. Here, as shown in FIG. 3A, even in the first dimming state, the lighting apparatus 1 is operated in a so-called continuous mode in which the switching element 162 is turned on again before the current I1 flowing through the inductor 163 becomes zero even if the switching element 162 is turned off.

As such, when the lighting apparatus 1 is in the first dimming state, since the On time of the switching element 162 is short, a peak of the current I1 flowing through the inductor 163 is reduced and the electromagnetic energy stored in the inductor 163 is also reduced, as compared to the full lighting state. As a result, when compared with the full lighting state, the current (the output current) supplied from the lighting apparatus 1 to the light source load 3 is reduced and the light output from the light source load 3 is reduced (becomes dark). In this case, the On time t2 of the switching element 162 is shorter than the On time t1 in the full lighting state ($t1>t2$) and the oscillating frequency f2 is approximately the same as the oscillating frequency f1 of the full lighting state ($f1\approx f2$).

Figure 4A:
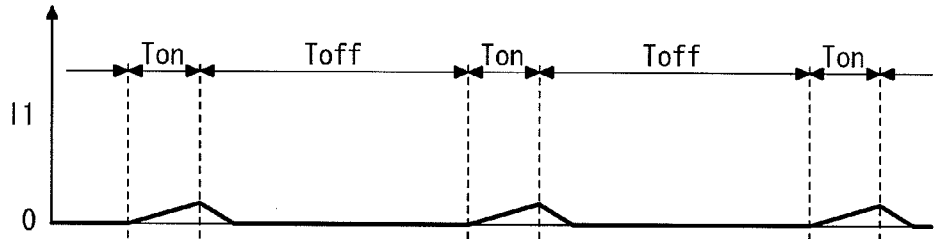
FIGS. 4A and 4B illustrate an operation of the lighting apparatus in a second dimming state according to the first embodiment.
Figure 4B:
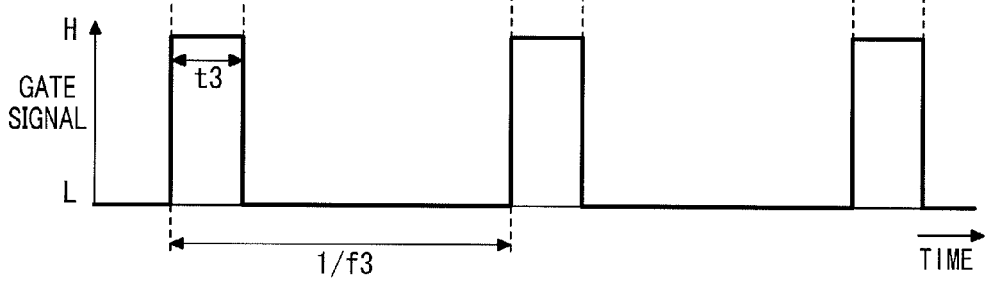

FIGS. 4A and 4B show an operation of the lighting apparatus 1 in the second dimming state.

In the second dimming state, the control circuit 4 mainly controls the oscillating frequency of the switching element 162 so that the On time t3 is approximately the same as the On time t2 of the first dimming state. That is, the control circuit 4 changes only the oscillating frequency of the switching element 162 so as to be reduced while fixing the On time of the switching element 162 from the first dimming state. Here, the operation of the lighting apparatus 1 is shifted from the continuous mode in which the current I1 continuously flows through the inductor 163 to the discontinuous mode in which the current I1 intermittently flows through the inductor 163 as shown in FIG. 4A.

As such, when the lighting apparatus 1 is in the second dimming state, the oscillating frequency of the switching element 162 is reduced and the Off time (the Off time per one period) of the switching element 162 is long accordingly. Therefore, when the lighting apparatus 1 is in the second dimming state, the peak of the current I1 flowing through the inductor 163 is reduced more and the electromagnetic energy stored in the inductor 163 is also reduced more, as compared to the first dimming state. As a result, when compared with the first dimming state, the current (the output current) supplied from the lighting apparatus 1 to the light source load 3 is reduced more and the light output from the light source load 3 is reduced more (becomes darker). In this case, the On time t3 of the switching element 162 is approximately the same as the On time t2 of the first dimming state (t2≈t3) and an oscillating frequency f3 is lower than the oscillating frequency f2 of the first dimming state (f2>f3).

Figure 5A:
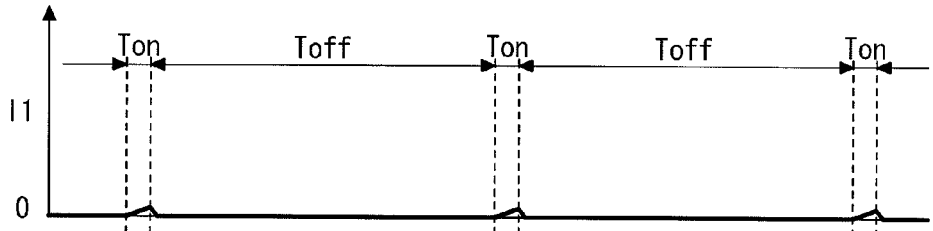
FIGS. 5A and 5B illustrate an operation of the lighting apparatus in a third dimming state according to the first embodiment.
Figure 5B:
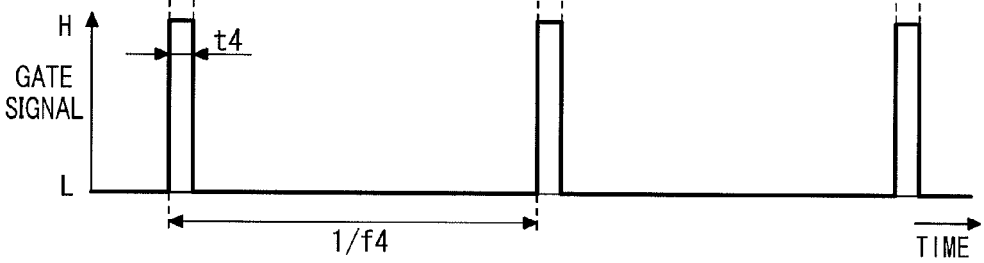

FIGS. 5A and 5B show an operation of the lighting apparatus 1 in the third dimming state.

In the third dimming state, the control circuit 4 mainly controls the On time of the switching element 162 so that an oscillating frequency f4 is approximately equal to the oscillating frequency f3 of the second dimming state. That is, the control circuit 4 changes only the On time of the switching element 162 so as to be short while fixing the oscillating frequency of the switching element 162 from the second dimming state.

As such, when the lighting apparatus 1 is in the third dimming state, since the On time of the switching element 162 is shorter, the peak of the current I1 flowing through the inductor 163 is reduced more and the electromagnetic energy stored in the inductor 163 is also reduced more, as compared to the second dimming state. As a result, when compared with the second dimming state, the current (the output current) supplied from the lighting apparatus 1 to the light source load 3 is reduced more and the light output from the light source load 3 is reduced more (becomes darker). In this case, the On time t4 of the switching element 162 is shorter than the On time t3 of the second dimming state (t3>t4) and the oscillating frequency f4 is approximately the same as the oscillating frequency f3 of the second dimming state (f3≈f4).

Consequently, the light source load 3 is brightest in the full lighting state and is darkest in the third dimming state.

The present embodiment illustrates the case in which the control circuit 4 continuously changes the On time of the switching element 162 in the second control mode and the oscillating frequency of the switching element 162 is continuously changed in the third control mode. However, the present embodiment is not limited to the example. For example, the control circuit 4 may change the On time of the switching element 162 stepwise (discontinuously) in the second control mode and may change the oscillating frequency of the switching element 162 stepwise (discontinuously) in the third control mode.

Next, a detailed configuration of the control circuit 4 will be described in more detail.

Figure 6:
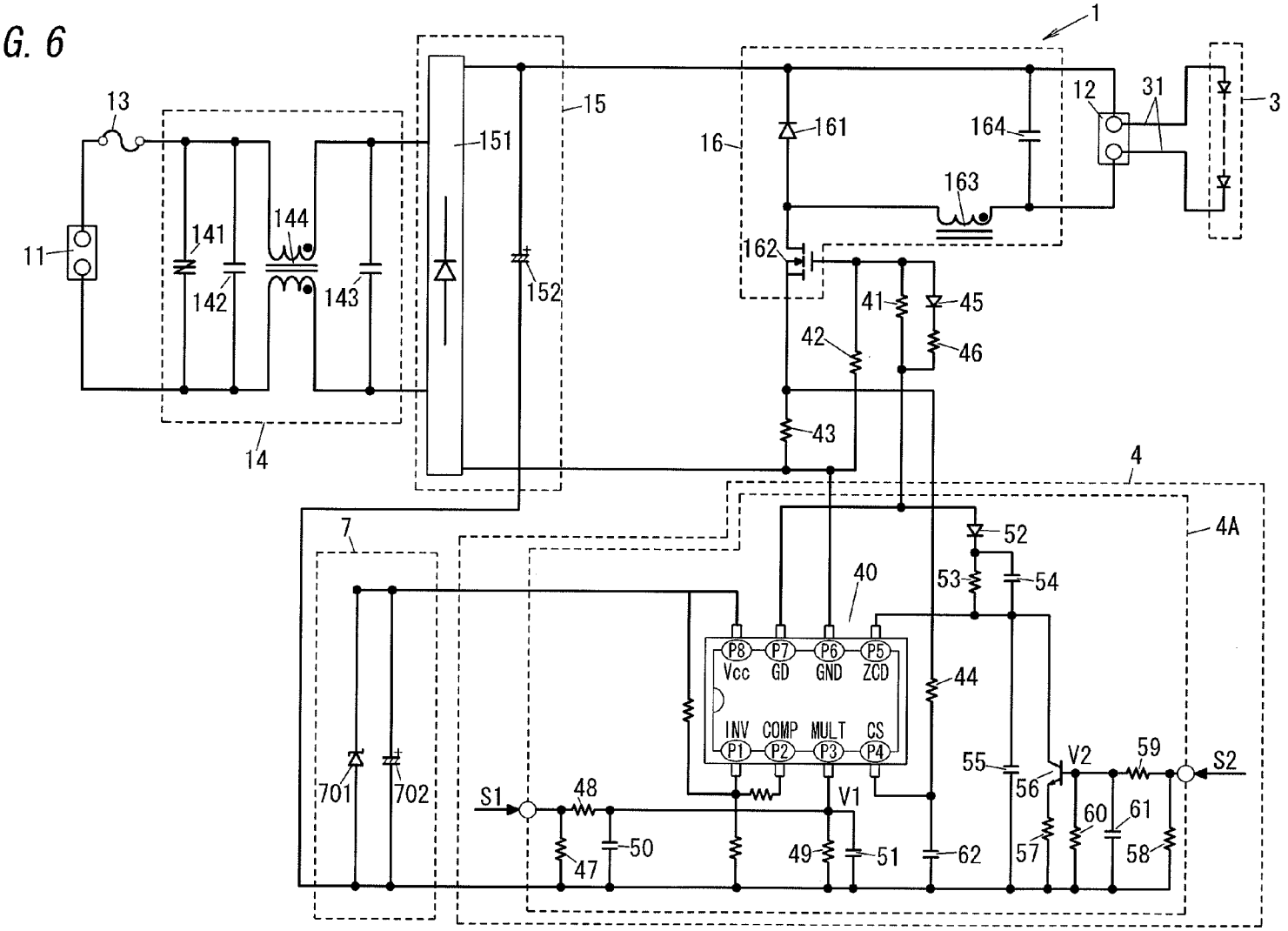
FIG. 6 is a circuit diagram showing the configuration of the lighting apparatus according to the first embodiment.

In the present embodiment, the driver circuit 4A of the control circuit 4 includes an integrated circuit (IC) 40 for control and peripheral components thereof as shown in FIG. 6. As the integrated circuit 40, "L6562" from ST Micro Electronic Co. is used herein. The integrated circuit (L6562) 40 is an original IC for controlling a PFC circuit (step-up chopper circuit for power factor improving control) and includes components unnecessary to control the step-down chopper circuit 16 therein, such as a multiplying circuit. On the other hand, the integrated circuit 40 includes a function of controlling a peak value of an input current and a function of controlling zero cross within one chip in order to control so that the average value of the input current becomes a similar figure to an envelope of an input voltage, and uses these functions for controlling the step-down chopper circuit 16.

The lighting apparatus 1 includes a control power supply circuit 7 that has a zener diode 701 and a smoothing capacitor 702, and is adapted to supply control power to the integrated circuit 40, and applies an output voltage of the control power supply circuit 7 to a power supply terminal (an eighth pin P8) of the integrated circuit 40.

Figure 7:
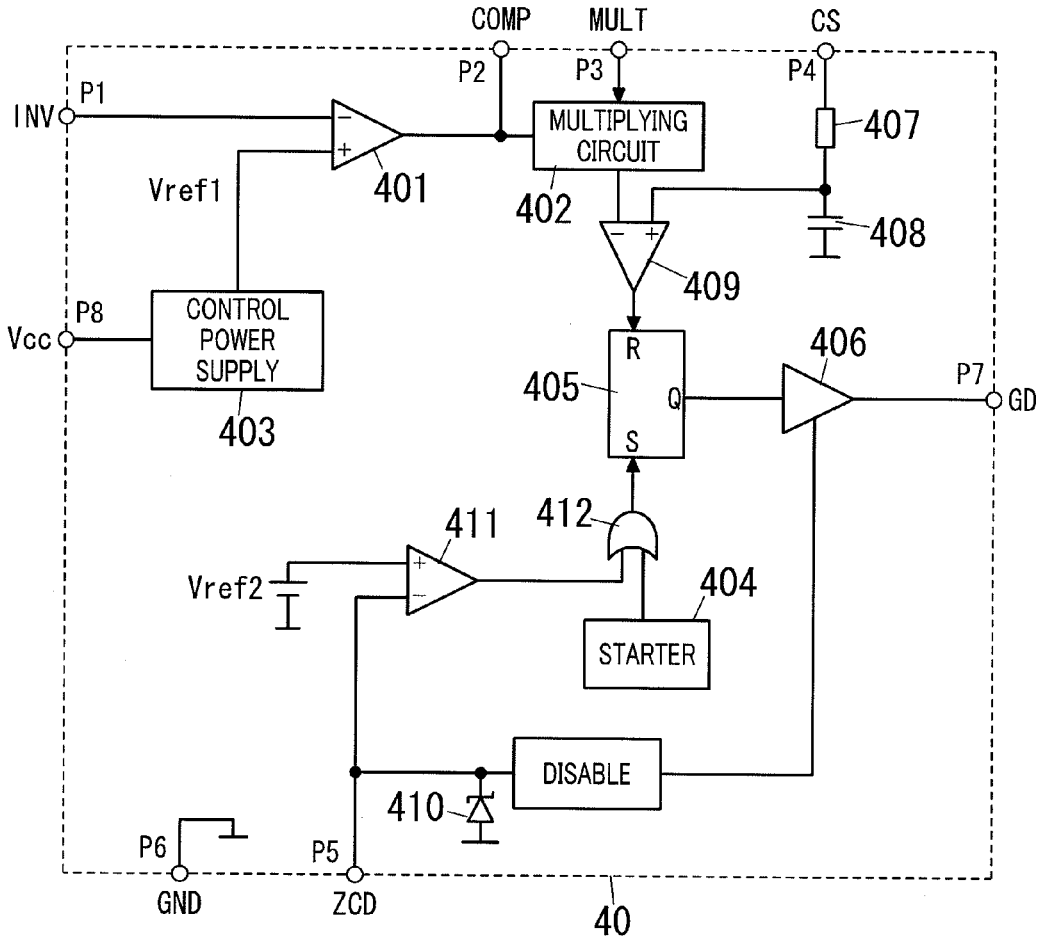
FIG. 7 is a circuit diagram showing the configuration of a control circuit of the lighting apparatus according to the first embodiment.

FIG. 7 schematically shows an internal configuration of the integrated circuit 40 used in the present embodiment. The first Pin (INV) P1 is an inverting input terminal of a built-in error amplifier 401 of the integrated circuit 40, the second pin (COMP) P2 is an output terminal of the error amplifier 401, and the third pin (MULT) P3 is an input terminal of an multiplying circuit 402. The fourth Pin (CS) P4 is a chopper current detection terminal, the fifth pin (ZCD) P5 is a zero cross detection terminal, the sixth pin (GND) P6 is a ground terminal, the seventh pin (GD) P7 is a gate drive terminal, and the eighth pin (Vcc) P8 is a power supply terminal.

When control power supply voltage of a predetermined voltage or more is applied between the eighth and sixth pins P8 and P6, reference voltages Vref1 and Vref2 are generated with a control power supply 403, and thus each circuit in the integrated circuit 40 can be operated. When power is applied to the integrated circuit 40, a start pulse is supplied to a set input terminal ("S" in FIG. 7) of a flip flop 405 through a starter 404, an output ("Q" in FIG. 7) of the flip flop 405 becomes the H level, and the seventh pin P7 becomes the H level through a driving circuit 406.

When the seventh pin P7 becomes the H level, a drive voltage (a gate signal) divided by the resistors 41 and 42 shown in FIG. 6 is applied between the gate and the source of the switching element 162. A resistor 43 inserted between a source terminal of the switching element 162 and a negative electrode of the DC power supply circuit 15 is a small resistor for detecting (measuring) a current flowing through the switching element 162 and hardly affects the driving voltage between the gate and the source.

When the switching element 162 is supplied with the drive voltage and then turned on, a current flows to a negative electrode of the smoothing capacitor 152 through the light source load 3, the inductor 163, the switching element 162, and the resistor 43 from a positive electrode of the smoothing capacitor 152. In this case, a chopper current flowing through the inductor 163 is an approximately linearly increasing current unless the inductor 163 is magnetic-saturated and is detected by the resistor 43 as a current sensing unit. A serial circuit of a resistor 44 and a capacitor 62 is connected between both ends of the (current sensing) resistor 43, and a connection point between the resistor 44 and the capacitor 62 is connected to the fourth pin P4 of the integrated circuit 40. Therefore, a voltage corresponding to the current value sensed through the resistor 43 is supplied to the fourth pin P4 of the integrated circuit 40.

A voltage value supplied to the fourth pin P4 of the integrated circuit 40 is applied to a "+" input terminal of a comparator 409 through a noise filter including a resistor 407 and a capacitor 408 therein. A reference voltage determined by the applied voltage to the first pin P1 and the applied voltage to the third pin P3 is applied to a "−" input terminal of the comparator 409 and the output of the comparator 409 is supplied to a reset terminal ("R" in FIG. 7) of the flip flop 405. In the aforementioned noise filter, the resistor 407 is, for example, 40 kΩ and the capacitor 408 is, for example, 5 pF.

Therefore, if the voltage of the fourth pin P4 of the integrated circuit 40 exceeds the reference voltage, the output of the comparator 409 becomes the H level and the reset signal is supplied to the reset terminal of the flip flop 405, and thus the output of the flip flop 405 becomes the L level. In this case, the seventh pin P7 of the integrated circuit 40 becomes the L level, and therefore the diode 45 of FIG. 6 is turned on, an electric charge between the gate and the source of the switching element 162 is extracted through a resistor 46, and thereby the switching element 162 is quickly turned off. When the switching element 162 is turned off, the electromagnetic energy stored in the inductor 163 is discharged to the light source load 3 through the diode 161.

In the present embodiment, resistors 47, 48, and 49 and capacitors 50 and 51 average a rectangular wave signal S1 from a signal generation circuit 21 (see FIG. 8) to be described below and a voltage having a size according to a duty ratio of the rectangular wave signal S1 is applied to the third pin P3. Therefore, the reference voltage across the comparator 409 is changed according to the duty ratio of the rectangular wave signal S1. Here, when the duty ratio of the rectangular wave signal S1 is large (when the time of the H level is long), the reference voltage is large and therefore, the On time of the switching element 162 is long. Meanwhile, when the duty ratio of the rectangular wave signal S1 is small (when the time of the H level is short), the reference voltage is small, and therefore the On time of the switching element 162 is short.

In other words, the control circuit 4 turns the switching element 162 off when a value of the current sensed (measured) through the resistor (the current sensing unit) 43 reaches a predetermined first value (corresponding to the reference voltage) determined by the rectangular wave signal S1. The On time of the switching element 162 is changed by changing the first value. Therefore, in the embodiment of the present invention, the On time of the switching element 162 can be changed using this principle in the first dimming state and the third dimming state.

As shown in FIG. 6, the Off time of the switching element 162 is determined by: a series circuit of the diode 52 and the resistor 53, connected between the seventh and fifth pins P7 and P5 of the integrated circuit 40; the capacitor 54 connected in parallel with the resistor 53; a capacitor 55; a transistor 56; and a resistor 57. The capacitor 55 is connected between the fifth pin P5 and ground, and the transistor 56 and the resistor 57 are connected in series with each other and are connected in parallel with the capacitor 55. Here, the resistors 58, 59, and 60 and the capacitor 61 average the rectangular wave signal S2 from the signal generation circuit 21 (see FIG. 8) to be described below and the voltage having a size according to the duty ratio of the rectangular wave signal S2 is applied between a base and an emitter of the transistor 56.

The integrated circuit 40 includes a built-in clamp circuit 410 connected to the fifth pin P5 as shown in FIG. 7, wherein the fifth pin P5 is clamped to a maximum of, e.g., 5.7 V. An output of a comparator 411 of which the "−" input terminal is connected to the fifth pin P5 becomes the H level when the input voltage of the fifth pin P5 is the reference voltage Vref2 (herein, 0.7 V) or less. Therefore, when the seventh pin P7 becomes the H level (generally about 10 to 15 V), the fifth pin P5 is clamped to 5.7 V. However, when the seventh pin P7 is the L level, the diode 52 is turned off and the capacitor 55 is discharged up to 0.7 V through the transistor 56 and the resistor 57.

At this time, the output of the comparator 411 becomes the H level. Therefore, the flip flop 405 connected to the output terminal of the comparator 411 through an OR circuit 412 is set and the output of the flip flop 405 also becomes the H level. Therefore, the seventh pin P7 becomes the H level again, and thus the switching element 162 is turned on. Thereafter, the control circuit 4 repeatedly performs the same operations, and thus the switching element 162 is turned on and off at a high frequency.

Here, as the duty ratio of the rectangular wave signal S2 is larger (as the time of the H level is longer), the voltage between a base and an emitter of the transistor 56 is more increased and a current flowing through the transistor 56 is also more increased. Therefore, the capacitor 55 is quickly discharged. Therefore, the Off time of the switching element 162 is short and the oscillating frequency of the switching element 162 is increased. On the other hand, as the duty ratio of the rectangular wave signal S2 is smaller (as the time of the H level is shorter), the voltage between the base and the emitter of the transistor 56 is more reduced and the current flowing through the transistor 56 is also more reduced. Accordingly, the discharge of the capacitor 55 is delayed. Therefore, the Off time of the switching element 162 is long and the oscillating frequency of the switching element 162 is reduced.

In other words, the control circuit 4 turns the switching element 162 on when a value of the voltage across the capacitor 55 charged by the driving signal of the switching element 162 becomes a predetermined threshold value (a value of the reference voltage Vref2) or less. Here, the control circuit 4 determines a discharge speed of the capacitor 55 based on a predetermined second value (the voltage between the base and the emitter of the transistor 56) determined by the rectangular wave signal S2, and changes the predetermined second value to change the oscillating frequency of the switching element 162. Therefore, in the second dimming state of the present embodiment, the oscillating frequency of the switching element 162 can be changed using this principle.

Figure 8:
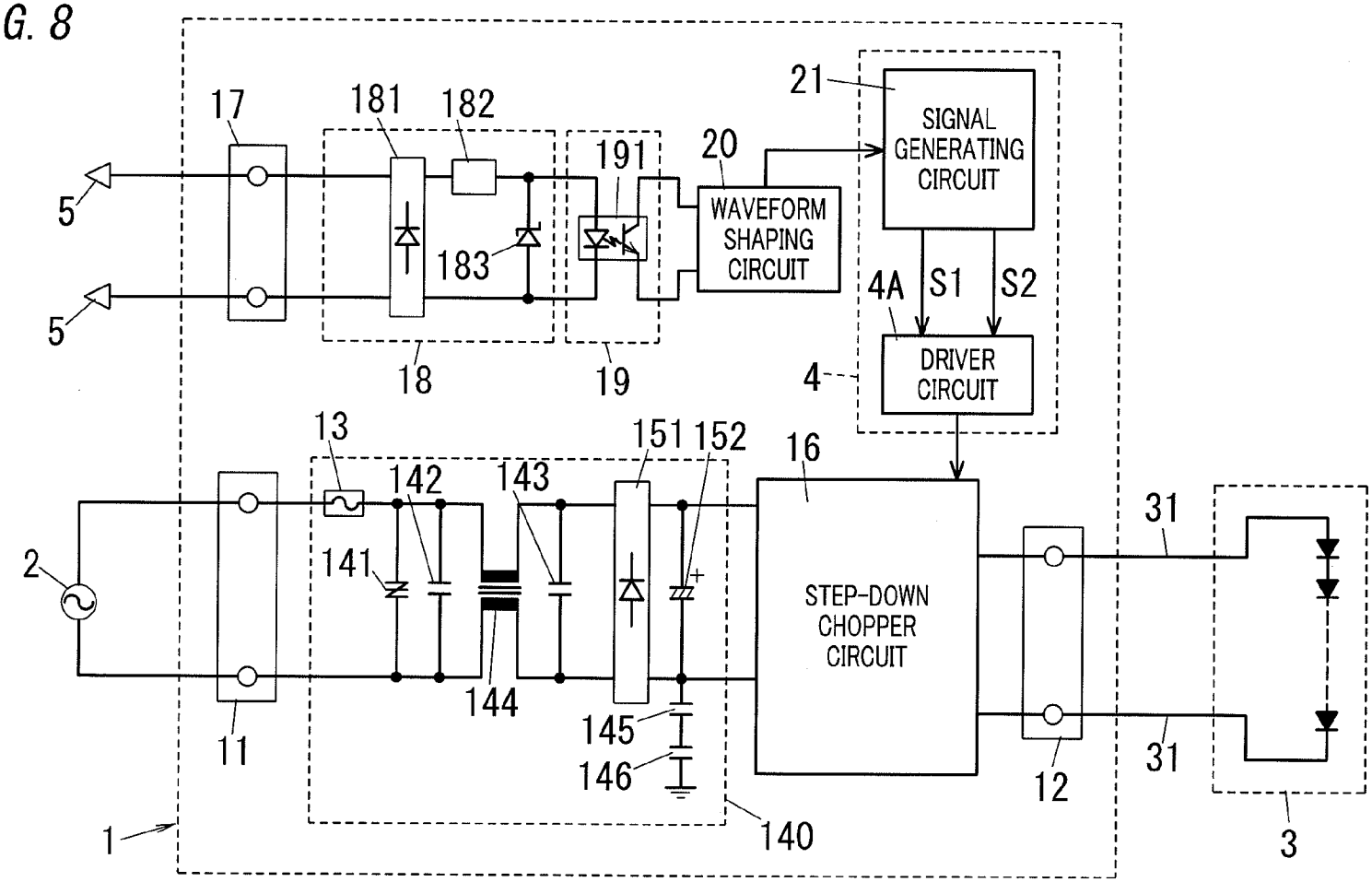
FIG. 8 is a circuit diagram showing the configuration of the lighting apparatus according to the first embodiment.

Next, the overall configuration of the lighting apparatus 1 in which the lighting apparatus 1 shown in FIG. 1 or 6 is added with a component receiving the dimming signal for determining the dimming ratio to generate the rectangular wave signals S1 and S2 will be described with reference to FIG. 8. FIG. 8 shows the DC power supply generation unit 140 in which the foregoing filter circuit 14 and DC power supply circuit 15 are combined and the capacitors 145 and 146 in the DC power supply generating unit 140 connect a circuit ground (the negative electrode of the capacitor 152) to a frame ground in high frequency.

In FIG. 8, the lighting apparatus 1 includes a signal line connector 17 for connecting a dimming signal line 5, a rectifying circuit 18, an insulating circuit 19, and a waveform shaping circuit 20, in addition to the components shown in FIG. 1 or 6. The control circuit 4 further includes the signal generating circuit 21, in addition to the driver circuit 4A. The dimming signal line 5 is supplied with the dimming signal including a rectangular wave voltage signal, wherein the duty ratio of the rectangular wave voltage signal is variable, and the frequency and amplitude of the rectangular wave voltage signal are, for example, 1 kHz and 10 V, respectively.

The rectifying circuit 18 is connected to the signal line connector 17 and is a circuit for converting wires of the dimming signal line 5 into non-polarized wires. The lighting apparatus 1 includes the rectifying circuit 18, and thus is normally operated even when the dimming signal line 5 is connected thereto reversely. That is, the rectifying circuit 18 includes: a full-wave rectifier 181 connected to the signal line connector 17; and a series circuit of a zener diode 183 and an impedance element 182 such as a resistor, connected in parallel with an output of the full-wave rectifier 181. Therefore, the rectifying circuit 18 full-wave rectifies the input dimming signal with the full-wave rectifier 181 and generates the rectangular wave voltage signal across the zener diode 183 through the impedance element 182.

The insulating circuit 19 includes a photocoupler 191 and serves to transfer the rectangular wave voltage signal to the control circuit 4 while insulating the dimming signal line 5 and the control circuit 4 of the lighting apparatus 1. The waveform shaping circuit 20 is adapted to shape a waveform of a signal output from the photocoupler 191 of the insulating circuit 19 so as to be output as a pulse width modulation (PWM) signal. Therefore, the waveform of the rectangular wave voltage signal (the dimming signal) transmitted far through the dimming signal line 5 may be distorted but the influence of the distortion is removed through the waveform shaping circuit 20.

Here, in a conventional inverter-type fluorescent lamp dimming ballast, a low pass filter circuit such as a CR integrating circuit (a smoothing circuit) is mounted at a latter stage of the waveform shaping circuit. The ballast is adapted to generate an analog dimming voltage and variably control a frequency of the inverter, and the like, according to the dimming voltage. In contrast, the lighting apparatus 1 according to the present embodiment is adapted to supply a PWM signal after the waveform shaping to the signal generation circuit 21.

The signal generation circuit 21 of the control circuit 4 includes a microcomputer and peripheral components thereof, which are not shown. The microcomputer is configured to measure an On time of the input PWM signal through a built-in timer and supply two kinds of rectangular wave signals S1 and S2 to the driver circuit 4A. The rectangular wave signals S1 and S2 supplied from the microcomputer are smoothed through the resistor and the capacitor within the driver circuit 4A, as described above. Therefore, as the duty ratio of the rectangular wave signal S1 is larger (as the time of the H level is longer), the input value in the driver circuit 4A is more increased. That is, as the duty ratio of the rectangular wave signal S1 is larger, the voltage V1 of the third pin P3 supplied with the smoothed rectangular wave signal S1 is more increased. As the duty ratio of the rectangular wave signal S2 is larger, the voltage V2 between the base and the emitter of the transistor 56, supplied with the smoothed rectangular wave signal S2 is more increased.

Figure 9A:
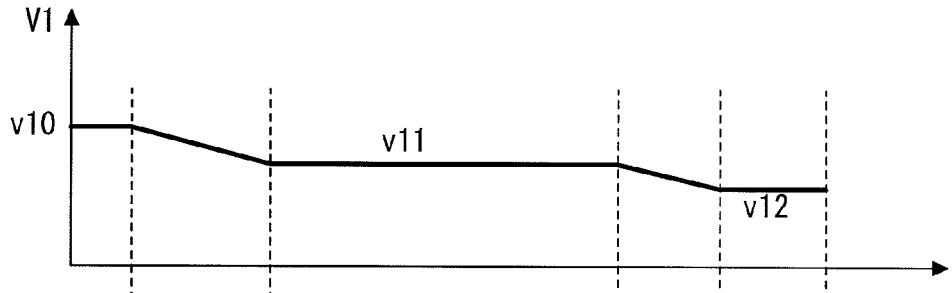
FIGS. 9A and 9B illustrate an operation of the lighting apparatus according to the first embodiment.
Figure 9B:
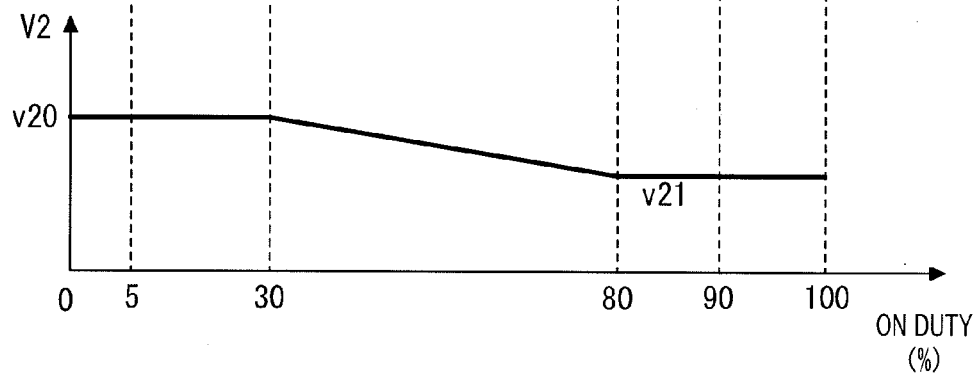

Next, when the PWM signal is changed, an operation of the lighting apparatus 1 will be described with reference to FIGS. 9A and 9B. In FIGS. 9A and 9B, each horizontal axis represents the duty ratio (On duty) of the PWM signal, FIG. 9A shows the voltage V1 applied to the third pin P3 of the integrated circuit 40 of the driver circuit 4A, and FIG. 9B shows the voltage V2 between a base and an emitter of a transistor 56. The duty ratio of the PWM signal corresponds to the duty ratio of the dimming signal since, for the PWM signal, the dimming signal is subjected to only the rectifying or the waveform shaping.

The first control mode is allocated for an interval in which a duty ratio (an On duty ratio) of the PWM signal is in a range of 0 to 5% (a first interval), where 0% is a first end of the first interval, and 5% is a second end of the first interval. As shown in FIGS. 9A and 9B, in the interval in which the duty ratio of the PWM signal is in a range of 0 to 5%, the voltage V1 of the third pin P3 and the voltage V2 between the base and the emitter of the transistor 56 are set as initial values (V1=v10, V2=v20), respectively. Therefore, in this interval, the lighting apparatus 1 is in the full lighting state and the oscillating frequency of the switching element 162 of the step-down chopper circuit 16 is f1 and the On time is t1.

The second control mode is allocated for an interval in which a duty ratio of the PWM signal is in a range of 5 to 30% (a second interval), where 5% is a first end of the second interval, and 30% is a second end of the second interval. In this interval, the signal generation circuit 21 reduces the duty ratio of the rectangular wave signal Si according to the increase in the duty ratio of the PWM signal to reduce the voltage V1 of the third pin P3 up to v11 (<v10). When the voltage V1 is reduced, the On time of the switching element 162 is short, and thus the load current (the output current supplied to the light source load 3) is reduced. In this case, in order to substantially and constantly maintain the oscillating frequency of the switching element 162, the signal generation circuit 21 may slightly reduce the duty ratio of the rectangular wave signal S2 to slightly reduce the voltage V2 and delay the discharge of the capacitor 55 to slightly increase the Off time of the switching element 162. This state becomes the first dimming state.

The third control mode is allocated for an interval in which a duty ratio of the PWM signal is in a range of 30 to 80% (a third interval), where 30% is a first end of the third interval, and 80% is a second end of the third interval. In this interval, the signal generation circuit 21 reduces the duty ratio of the rectangular wave signal S2 according to the increase in the duty ratio of the PWM signal, thereby reducing the voltage V2 between the base and the emitter up to v21 (<v20). When the voltage V2 is reduced, drawn current of the transistor 56 is reduced and discharging time of the capacitor 55 is increased so that the Off time of the switching element 162 is long and the oscillating frequency is reduced, such that the load current is reduced. In this case, the voltage V1 of the third pin P3 maintains a value of v11, and therefore the On time of the switching element 162 is constant. This state becomes the second dimming state.

The second control mode is allocated for an interval in which a duty ratio of the PWM signal is in a range of 80 to 90% (a fourth interval), where 80% is a first end of the fourth interval, and 90% is a second end of the fourth interval. In the fourth interval, the signal generation circuit 21 reduces the duty ratio of the rectangular wave signal S1 according to the increase in the duty ratio of the PWM signal, reducing the voltage V1 of the third pin P3 up to v12 (<v11). When the voltage V1 is reduced, the On time of the switching element 162 is shorter, and thus the load current is reduced more. In this case, in order to substantially and constantly maintain the oscillating frequency of the switching element 162, the signal generation circuit 21 may slightly reduce the duty ratio of the rectangular wave signal S2 to slightly reduce the voltage V2 and delay the discharge of the capacitor 55 to slightly increase the Off time of the switching element 162. This state becomes the third dimming state.

In an interval (a fifth interval) in which a duty ratio of the PWM signal is in a range of 90 to 100%, the signal generation circuit 21 is set to constantly maintain the duty ratios of the rectangular wave signals S1 and S2, thereby maintaining the third dimming state. Alternatively, in the interval in which the duty ratio of the PWM signal is in a range of 90% to 100%, the lighting apparatus 1 may set at least one of the voltage V1 of the third pin P3 and the voltage V2 between the base and the emitter to the L level to stop the operation of the step-down chopper circuit 16 and turn the light source load 3 off. That is, the control circuit 4 may set at least one of a predetermined first value (corresponding to the reference voltage) determined by the rectangular wave signal S1 and a predetermined second value (the voltage V2 between the base and the emitter) determined by the rectangular wave signal S2 to zero or less to stop the On an Off operation of the switching element 162.

The control circuit 4 sets the oscillating frequency of the switching element 162 to be in a range of 1 kHz or more, preferably, several kHz or more. Therefore, even in the second or third dimming state in which the oscillating frequency is reduced, a flicker frequency of the light source load 3 is high and the interference between the flicker of the light source load 3 and the shutter speed (the exposure time), for example, at the time of the camera photographing can be avoided.

According to the lighting apparatus 1 of the present embodiment as described above, the control circuit 4 randomly selects the second control mode for changing the On time of the switching element 162 and the third control mode for changing the oscillating frequency in a multi stage, thereby dimming the light source load 3. Therefore, when comparing with the case in which the light source load 3 is dimmed based on only the second control mode or the third control mode, the lighting apparatus 1 may expand the dimming range of the light source load 3 without flickering the light source load 3. As a result, the lighting apparatus 1 can precisely (finely) control the brightness of the light source load 3 over the relatively wide range.

In addition, the control of the dimming ratio in the dimming state is performed through the signal generation circuit 21 including the microcomputer as a main component, such that the lighting apparatus 1 that can precisely (finely) control the brightness of the light source load 3 with the relatively simple configuration can be realized.

In the present embodiment, the dimming signal supplied to the lighting apparatus 1 is the rectangular wave of which the duty ratio varies, but it is not limited thereto. For example, the dimming signal may be a DC voltage of which the voltage value varies. In this case, the signal generation circuit 21 including the microcomputer realizes the dimming control by controlling the duty ratios of the rectangular wave signals S1 and S2 based on the amplitude (the voltage value) of the dimming signal. The lighting apparatus 1 is not limited as a configuration that inputs the dimming signal from the dimming signal line 5. For example, the lighting apparatus 1 may be a configuration in which an infrared light receiving module is mounted to receive the dimming signal by infrared communication.

(Second Embodiment)

Figure 10:
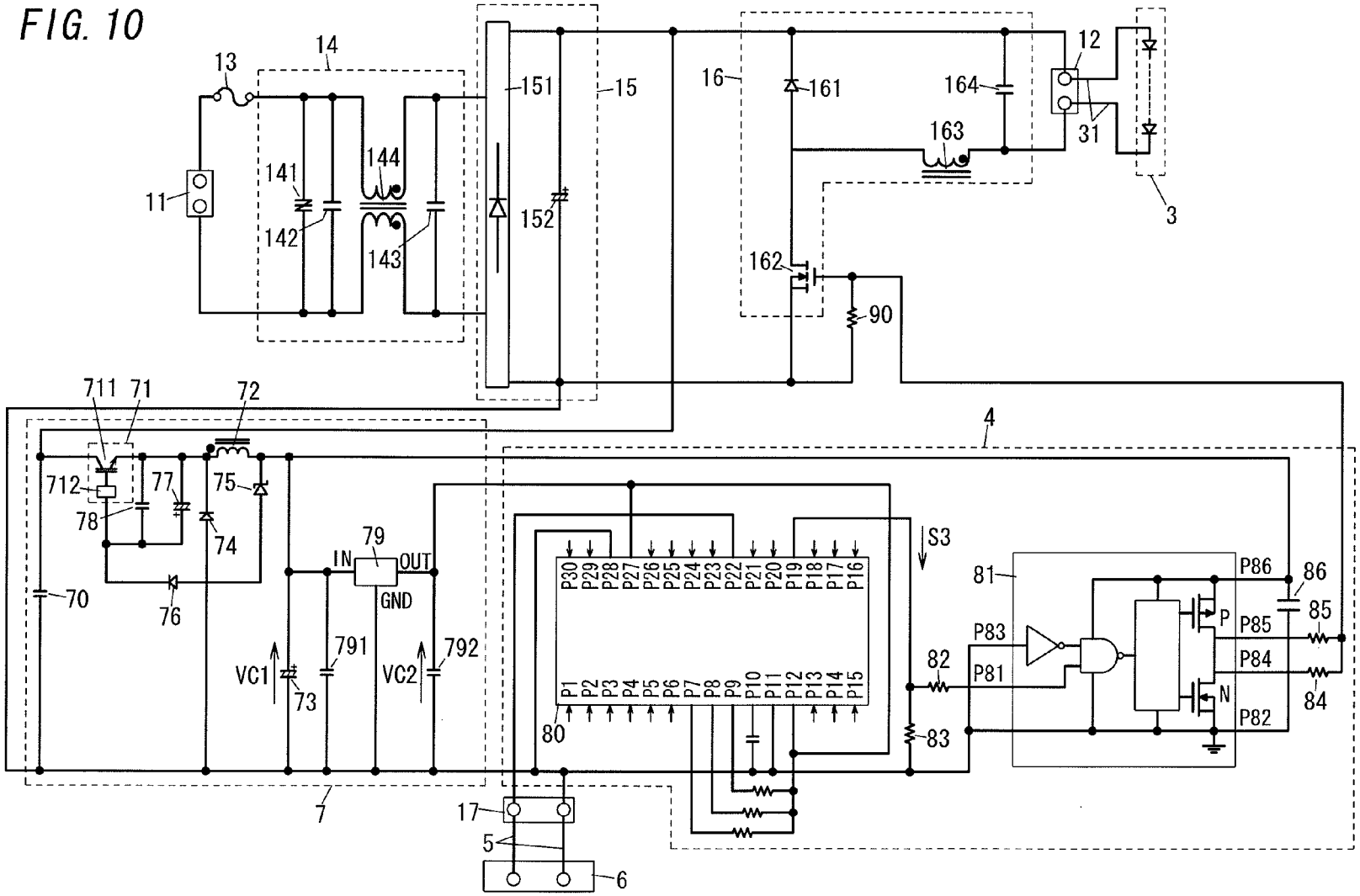
FIG. 10 is a circuit diagram showing the configuration of a lighting apparatus according to a second embodiment of the present invention.

The lighting apparatus 1 according to the present embodiment is different from the lighting apparatus 1 according to the first embodiment in terms of the configuration of the control circuit 4 and the control power supply circuit 7, as shown in FIG. 10. In the example of FIG. 10, an external dimmer 6 outputting the rectangular wave voltage signal of 5 V, 1 kHz as the dimming signal is connected to the signal line connector 17 of the lighting apparatus 1 through the dimming signal line 5. Hereinafter, the same components as in the first embodiment are denoted by the same reference numerals and the description thereof will not be repeated here.

As shown in FIG. 10, in the present embodiment, the control power supply circuit 7 includes an IPD element 71 connected to the smoothing capacitor 152, and peripheral components thereof. The IPD element 71 is a so-called intelligent power device and for example, "MIP2E2D" from Panasonic is used for the element. The IPD element 71, which is a three-pin integrated circuit having a drain terminal, a source terminal, and a control terminal, includes a built-in switching element 711 including a power MOSFET and a built-in controller 712 adapted to turn the switching element 711 on and off. In the control power supply circuit 7, the step-down chopper circuit includes the built-in switching element 711 in the IPD device 71, the inductor 72, the smoothing capacitor 73, and the diode 74. In the control power supply circuit 7, the power supply circuit of the IPD element 71 includes a zener diode 75, a diode 76, a smoothing capacitor 77, and a capacitor 78. A capacitor 70 for noise cut is connected to the drain terminal of the IPD element 71.

By the above configuration, the control power supply circuit 7 generates a constant voltage (for example, about 15 V) across the smoothing capacitor 73, wherein the constant voltage is a power supply voltage VC1 for supplying the control power of the integrated circuit (a three-terminal regulator 79, a microcomputer 80, and a driver circuit 81) to be described below. Therefore, because the smoothing capacitor 73 is uncharged until the IPD element 71 starts operation, other integrated circuits (the three-terminal regulator 79, the microcomputer 80, and the driver circuit 81) are not operated.

Hereinafter, an operation of the control power supply circuit 7 will be described.

At the early stage of power up, when the smoothing capacitor 152 is charged by the output voltage of the full-wave rectifier 151, a current flows along a path of drain terminal of the IPD element 71, control terminal of the IPD element 71, smoothing capacitor 77, inductor 72, and smoothing capacitor 73. Therefore, the smoothing capacitor 73 is charged with the polarity as shown in FIG. 10 and supplies an operating voltage to the IPD element 71. Therefore, the IPD element 71 is activated and turns the built-in switching element 711 on and off.

When the built-in switching element 711 of the IPD element 71 is turned on, a current flows along a path of smoothing capacitor 152, drain terminal of IPD element 71, source terminal of IPD element 71, inductor 72 and smoothing capacitor 73, and thus the smoothing capacitor 73 is charged. When the switching element 711 is turned off, the electromagnetic energy stored in the inductor 72 is discharged to the smoothing capacitor 73 through the diode 74. Therefore, the circuit including the IPD element 71, the inductor 72, the diode 74, and the smoothing capacitor 73 is operated as the step-down chopper circuit, such that the power supply voltage VC1 obtained by stepping down the voltage across the smoothing capacitor 152 is generated across the smoothing capacitor 73.

When the built-in switching element 711 in the IPD element 71 is turned off, the regenerative current flows through the diode 74. However, the voltage across the inductor 72 is clamped to a sum voltage of voltage across the smoothing capacitor 73 and forward voltage of the diode 74. Voltage obtained by subtracting the zener voltage of the zener diode 75 and the forward voltage of the diode 76 from the sum voltage becomes a voltage across the smoothing capacitor 77. A built-in controller 712 in the IPD element 71 is adapted to control the On and Off operation of the switching element 711 so that the voltage across the smoothing capacitor 77 is constant. As a result, the voltage (the power supply voltage VC1) across the smoothing capacitor 73 is also constant.

When the power supply voltage VC1 is generated across the smoothing capacitor 73, the three-terminal regulator 79 starts supplying the power supply voltage VC2 (for example, 5 V) to the microcomputer 80 to start the On and Off control of the switching element 162 of the step-down chopper circuit 16. The microcomputer 80 is supplied with the dimming signal from the external dimmer 6 and performs the dimming control.

As shown in FIG. 10, the control circuit 4 includes the microcomputer 80 and is configured to generate the rectangular wave signal for driving the switching element 162 of the step-down chopper circuit 16 based on internal programs. The microcomputer 80 has programs set to output the rectangular wave signal S3 (for example, amplitude of 5V) for driving the switching element 162 from the nineteenth pin P19 according to the On time (the pulse width) of the dimming signal from the external dimmer 6 supplied to the twenty-second pin P22. Further, the control circuit 4 includes the driver circuit 81 that receives the output (the rectangular wave signal S3) from the nineteenth pin P19 of the microcomputer 80 to actually drive the switching element 162. Therefore, the microcomputer 80 controls the switching element 162 by receiving the dimming signal from the external dimmer 6 to control the current flowing through the light source load 3, thereby realizing the dimming control.

The control circuit 4 of the present embodiment is described below.

An input terminal of the three-terminal regulator 79 is connected to a positive electrode of the smoothing capacitor 73, while an output terminal of the three-terminal regulator 79 is connected to the twenty-seventh pin P27 (a power terminal) of the microcomputer 80. A capacitor 791 is connected between the input terminal and a ground terminal of the three-terminal regulator 79. A capacitor 792 is connected between an output terminal and the ground terminal of the three-terminal regulator 79. The twenty-eighth pin P28 (a ground terminal) of the microcomputer 80 is connected to ground. Thus, the three-terminal regulator 79 is configured to convert the voltage across the smoothing capacitor 73 (power supply voltage VC1) into the power supply voltage VC2 for a microcomputer (herein, 5V) across the capacitor 792, thereby supplying power to the microcomputer 80.

The twenty-second pin P22 of the microcomputer 80 is connected to the external dimmer 6 through the signal line connector 17, and is supplied with the dimming signal from the external dimmer 6 through the dimming signal line 5. As mentioned above, the dimming signal line 5 is supplied with the dimming signal including a rectangular wave voltage signal, wherein the duty ratio of the rectangular wave voltage signal is variable, and the frequency and amplitude of the rectangular wave voltage signal are, for example, 1 kHz and 5 V, respectively. The microcomputer 80 is configured to output, from the nineteenth pin P19, the rectangular wave signal S3 for turning on and off of the switching element 162 in accordance with the duty ratio of the dimming signal. The driver circuit 81 drives the switching element 162 in accordance with the rectangular wave signal S3.

The driver circuit 81 has the first to sixth pins (P81-P86). The first pin P81 is a positive input terminal, and is connected to the nineteenth pin P19 of the microcomputer 80 through a resistor 82 of, e.g., 1 kΩ. A connection point between the resistor 82 and the nineteenth pin P19 of the microcomputer 80 is connected to ground through a resistor 83 of, e.g., 100 kΩ. The second pin P82 is a ground terminal and connected to ground. The third pin P83 is a negative input terminal and connected to ground. The fourth pin P84 is an output terminal (a SYNC output terminal) of a built-in N-channel MOSFET and connected to the gate terminal of the switching element 162 through a resistor 84 of, e.g., 10 kΩ. The fifth pin P85 is an output terminal (a source output terminal) of a built-in P-channel MOSFET and connected to the gate terminal of the switching element 162 through a resistor 85 of, e.g., 300Ω. The gate terminal of the switching element 162 is also connected to ground through a resistor 90. The sixth pin P86 is a power terminal, and is connected to the positive electrode of the smoothing capacitor 73 and also connected to ground through a capacitor 86 of, e.g., 0.1 μF. The sixth pin P86 is supplied with the power supply voltage VC1 (the voltage across the smoothing capacitor 73).

The driver circuit 81 amplifies the rectangular wave signal S3 having an amplitude of, e.g., 5V from the microcomputer 80 so that the amplitude becomes, e.g., 15V, and supplies the amplified signal to the gate terminal of the switching element 162, thereby turning the switching element 162 on and off.

Here, in the present embodiment, the three-terminal regulator 79 is, for example, "TA78L05" from Toshiba Co., the microcomputer 80 is an 8-bit microcomputer "78K0/Ix2" from RENESAS Co., and the driver circuit 81 is "MAX15070A" from Maxim Co. Here, the output capacitor 164 inhibiting a pulsation (a ripple) of the output to the light source load 3 is shown with a broken line in FIG. 10.

However, the lighting apparatus 1 in the present embodiment is adapted so that according to the duty ratio (the dimming ratio) of the dimming signal, the apparatus 1 switches the full lighting state in which full lighting of the light source load 3 is performed and the first and second dimming states in which the light source load 3 is dimmed. The first dimming state mentioned herein is a lighting state based on the third control mode in which the On time of the switching element 162 is approximately fixed and the oscillating frequency of the switching element 162 is changed. The second dimming state is a lighting state in which the second control mode in which the oscillating frequency of the switching element 162 is approximately fixed and the On time of the switching element 162 is changed, is further selected from the first dimming state.

Figure 11:
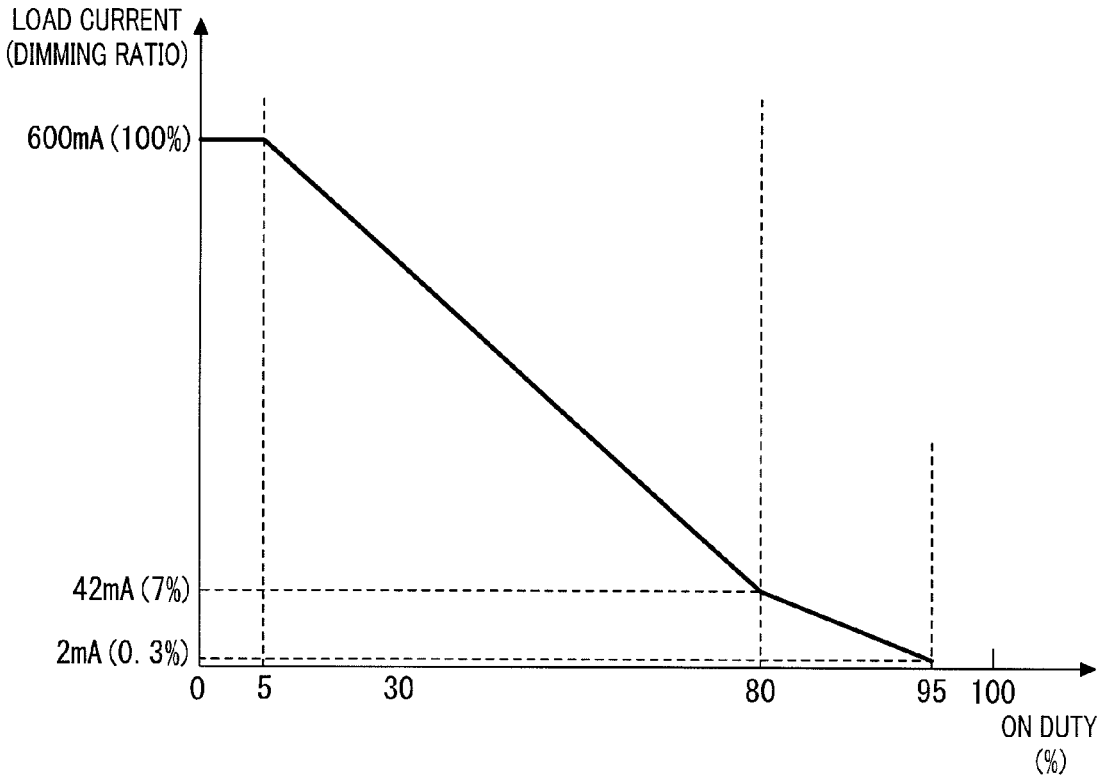
FIG. 11 is a view for describing the operation of the lighting apparatus according to the second embodiment.

Next, an operation of the lighting apparatus 1 according to the present embodiment will be described with reference to FIG. 11 and FIGS. 12A to 12F. FIG. 11 shows the dimming ratio (in parentheses in FIG. 11) when the horizontal axis represents the duty ratio (On duty) of the dimming signal (the PWM signal) from the external dimmer 6 and the vertical axis represents the load current (an effective value of the output current supplied to the light source load 3) and 600 mA is the full lighting (100%).

Figure 12A:
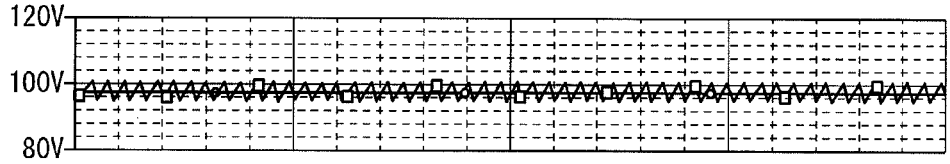
FIGS. 12A-12F illustrate an operation of the lighting apparatus according to the second embodiment.
Figure 12B:
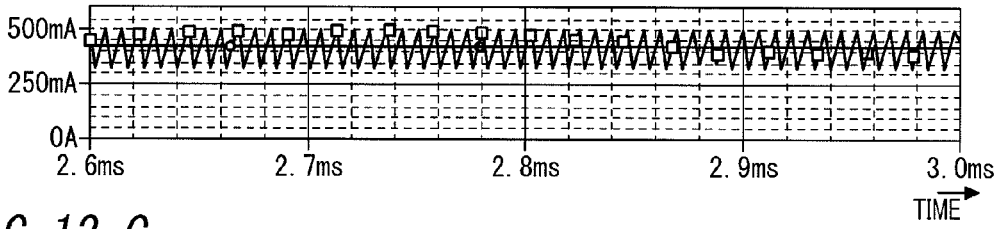

First, the first control mode is allocated for an interval in which a duty ratio of the PWM signal is in a range of 0 to 5% (a first interval). In the first interval, the microcomputer 80 outputs the constant rectangular wave signal S3 for driving the switching element 162 from the nineteenth pin P19. In this case, the rectangular wave signal S3 in the embodiment is set so that the oscillating frequency is 140 kHz, the On time is 5 μs and the voltage value is 5 V. The driver circuit 81 amplifies the voltage value to 15 V by receiving the rectangular wave signal S3 and supplies the amplified signal to the gate of the switching element 162 of the step-down chopper circuit 16 to turn the switching element 162 on and off. In this case, the lighting apparatus 1 is operated in the full lighting state and the output current of 600 mA in average flows through the light source load 3 (the dimming ratio of 100%). The lighting apparatus 1 continues the state (the full lighting state) until the duty ratio of the dimming signal reaches 5%. In FIGS. 12A and 12B, each horizontal axis represents time, and FIG. 12A shows a voltage across the light source load 3 in the state (the full lighting state), and FIG. 12B shows a current flowing through the light source load 3.

Figure 12C:
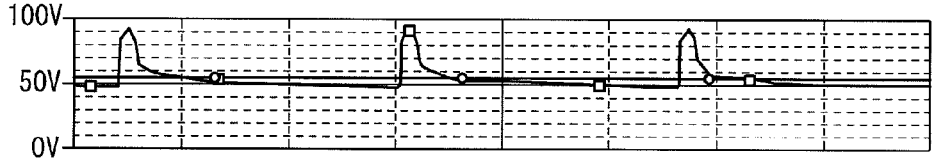
Figure 12D:
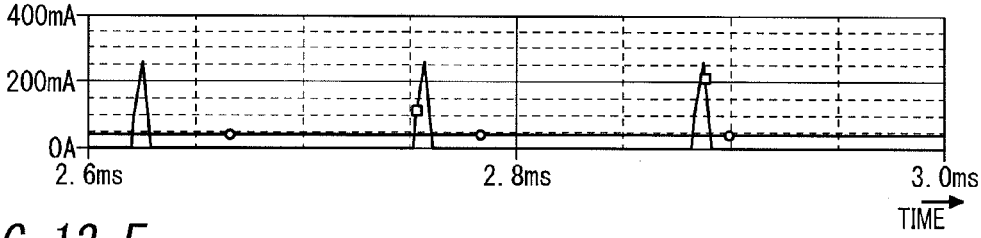

Next, the third control mode is allocated for an interval (a second interval) in which a duty ratio of the dimming signal is a range of 5 to 80%. In this interval, the microcomputer 80 gradually reduces the oscillating frequency of the rectangular wave signal S3 supplied from the nineteenth pin P19 according to the increase in the duty ratio of the dimming signal. In the present embodiment, the microcomputer 80 approximately maintains the On time of the rectangular wave signal S3 as a predetermined value (5 μs) and gradually increases the Off time of the rectangular wave signal S3 according to the increase in the duty ratio of the dimming signal. Here, when the duty ratio of the dimming signal is 80%, the program of the microcomputer 80 is set so that the oscillating frequency of the rectangular wave signal S3 supplied from the nineteenth pin P19 is 8 kHz. In this case, the lighting apparatus 1 is operated in the first dimming state and an average of the output current flowing through the light source load 3 is controlled to 42 mA (the dimming ratio of 7%) as a lower limit. In FIGS. 12C and 12D, each horizontal axis represents time, and FIG. 12C shows a voltage across the light source load 3 in the state (the first dimming state), and FIG. 12D shows a current flowing through the light source load 3.

Figure 12E:
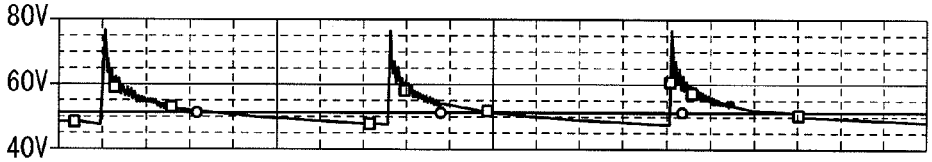
Figure 12F:
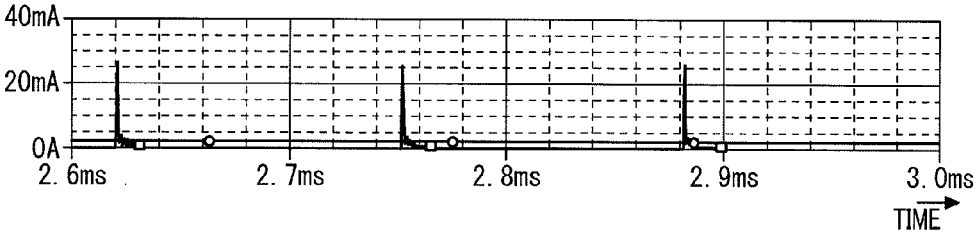

The second control mode is allocated for an interval (a third interval) in which a duty ratio of the dimming signal is a range of 80 to 95%. In this interval, the microcomputer 80 gradually reduces the On time of the rectangular wave signal S3 supplied from the nineteenth pin P19 according to the increase in the duty ratio of the dimming signal. In the present embodiment, the microcomputer 80 changes the On time according to the duty ratio of the dimming signal while making the oscillating frequency approximately constant as a predetermined value (8 kHz). Here, when the duty ratio of the dimming signal is 95%, the program of the microcomputer 80 is set so that the On time of the rectangular wave signal S3 supplied from the nineteenth pin P19 is 0.5 μs. In this case, the lighting apparatus 1 is operated in the second dimming state and an average of the output current flowing through the light source load 3 is controlled to 2 mA (the dimming ratio of 0.3%) as a lower limit. In FIGS. 12E and 12F, each horizontal axis represents time, and FIG. 12E shows a voltage across the light source load 3 in the state (the second dimming state), and FIG. 12F shows a current flowing through the light source load 3.

In the present embodiment, the lighting apparatus 1 stops the operation of the step-down chopper circuit 16 and turns the light source load 3 off by setting the output from the nineteenth pin P19 of the microcomputer 80 to the L level in an interval (a fourth interval) in which a duty ratio of the PWM signal is in a range of 95% or more (see FIG. 11).

According to the lighting apparatus 1 of the present embodiment as described above, the control circuit 4 dims the light source load 3 by randomly selecting the second control mode for changing the On time of the switching element 162 and the third control mode for changing the oscillating frequency in a multi stage. Therefore, when compared with the case in which the light source load 3 is dimmed based on only the second control mode or the third control mode, the lighting apparatus 1 may expand the dimming range of the light source load 3 without flickering the light source load 3. As a result, the lighting apparatus 1 can precisely (finely) control the brightness of the light source load 3 over the relatively wide range.

In addition, the control of the dimming ratio in the dimming state is performed with the microcomputer 80 of the control circuit 4, such that the lighting apparatus 1 that can precisely (finely) control the brightness of the light source load 3 with the relatively simple configuration can be realized.

Other components and functions are the same as the above first embodiment.

Figure 13:
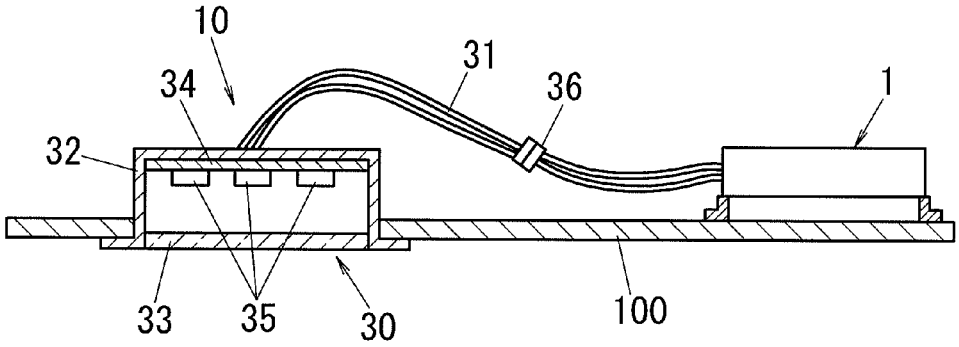
FIG. 13 is a sectional view showing an illuminating fixture including the lighting apparatus.

However, each lighting apparatus 1 described in the embodiments configures the illuminating fixture together with the light source load 3 comprising the semiconductor light emitting device (LED module). As shown in FIG. 13, in the illuminating fixture 10, the lighting apparatus 1 as a power supply unit is received in a case separate from an appliance housing 32 of the LED module (the light source load 3) 30. The lighting apparatus 1 is connected to the LED module 30 through a lead wire 31. Therefore, the illuminating fixture 10 can implement the slimness of the LED module 30 and increase the degree of freedom of the installation place of the lighting apparatus 1 as a separate mounting type of the power supply unit.

In the example of FIG. 13, the appliance housing 32 is a cylinder shaped housing having an upper base and an opened bottom made of a metal material, when the opened surface (the bottom surface) is covered with a light diffusing sheet 33. In the LED module 30, a plurality of (herein, four) LEDs 35 are mounted on one surface of a substrate 34 and are disposed in a relationship opposite to (facing) the light diffusing sheet 33 within the appliance housing 32. The appliance housing 32 is buried in a ceiling 100 and is connected to the lighting apparatus 1 as the power supply unit disposed behind the ceiling through the lead wires 31 and the connectors 36.

The illuminating fixture 10 is not limited to a separate mounting type configuration in which the lighting apparatus 1 as the power supply unit is received in the case separate from that of the LED module 30. For example, the fixture 10 may be a power supply integrated type configuration in which the LED module 30 and the lighting apparatus 1 are received in the same housing.

Each lighting apparatus 1 described in the embodiments is not limited to be used for the illuminating fixture 10. Each lighting apparatus 1 may be used for various light sources, for example, a backlight of a liquid crystal display, a copier, a scanner, a projector, and the like. Alternatively, the light source load 3 emitting light by receiving the power supply from the lighting apparatus 1 is not limited to the light emitting diode (LED). For example, the light source load 3 may comprise a semiconductor light emitting element such as, for example, an organic EL device, a semiconductor laser device, etc.

Figure 14A:
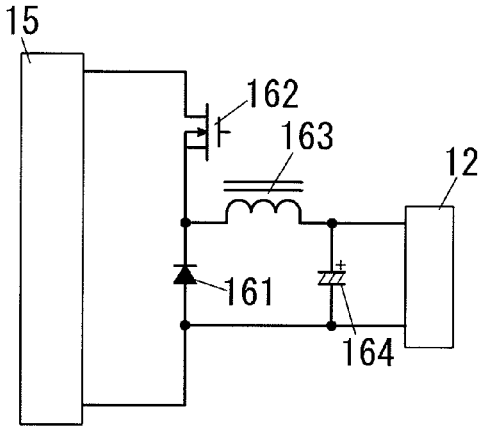
FIGS. 14A-14D illustrate circuit diagrams showing major portions of other configurations of the lighting apparatus.

Further, in each embodiment, the step-down chopper circuit 16 has a configuration in which the switching element 162 is connected to the low potential (negative) side of the output terminals of the DC power supply circuit 15 and the diode 161 is connected to the high potential (positive) side thereof, but it is not limited thereto. That is, the step-down chopper circuit 16 may have a configuration in which the switching element 162 is connected to the high potential side of the output terminals of the DC power supply circuit 15, as shown in FIG. 14A.

Figure 14B:
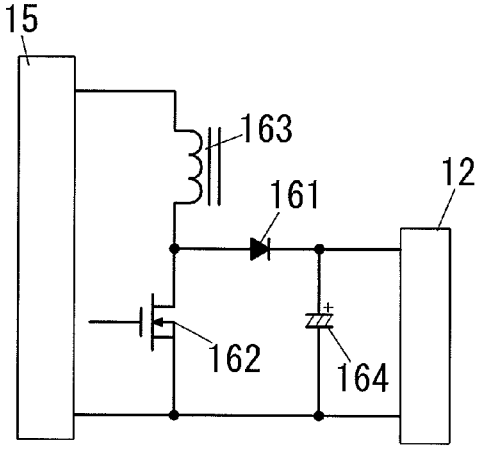
Figure 14C:
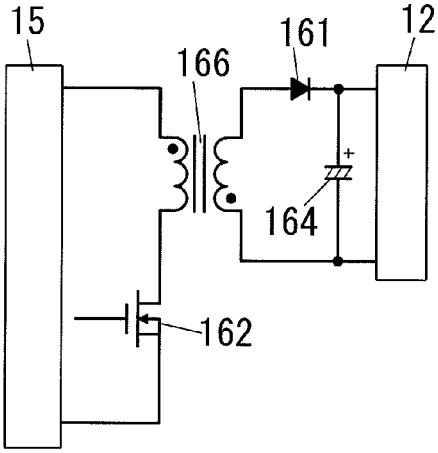
Figure 14D:
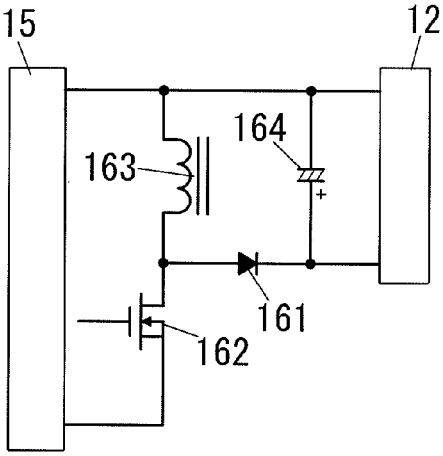

The lighting apparatus 1 is not limited to the configuration in which the step-down chopper circuit 16 is applied thereto but as shown in FIGS. 14B to 14D, may include various switching power supply circuits other than the step-down chopper circuit formed between the DC power supply circuit 15 and the output connector 12. FIG. 14B shows the case in which the step-up chopper circuit is applied, FIG. 14C shows the case in which a flyback converter circuit is applied, and FIG. 14D shows the case in which the step-down and step-up chopper circuit is applied.

The step-up chopper circuit shown in FIG. 14B is configured so that the inductor 163 and the switching element 162 are connected in series between the output terminals of the DC power supply circuit 15, and the diode 161 and the output capacitor 164 are connected in series between both terminals of the switching element 162. The flyback converter circuit shown in FIG. 14C is configured so that a primary winding of a transformer 166 and the switching element 162 are connected in series between the output terminals of the DC power supply circuit 15, and the diode 161 and the output capacitor 164 are connected in series to each other and connected in parallel with a secondary winding of the transformer 166. The step-down and step-up chopper circuit shown in FIG. 14D is configured so that the inductor 163 and the switching element 162 are connected in series between the output terminals of the DC power supply circuit 15, and the diode 161 and the output capacitor 164 are connected in series to each other and connected in parallel with the inductor 163.

Although the present invention has been described with reference to certain preferred embodiments, numerous modifications and variations can be made by those skilled in the art without departing from the true spirit and scope of this invention, namely claims.

The invention claimed is:

1. A lighting apparatus, comprising:

a switching element connected to a DC power supply and controlled to be turned on and off;

an inductor through which a current flows from the DC power supply when the switching element is turned on, said inductor being connected to the switching element;

a diode that discharges electromagnetic energy stored in the inductor, when the switching element is turned on, to a light source load comprising a semiconductor light emitting element when the switching element is turned off; and a control circuit adapted to receive a dimming signal corresponding to a dimmer setting corresponding to a brightness level of the light source load and to control an On and Off operation of the switching element, wherein the control circuit operates in first, second and third control modes as control modes of the switching element, and is adapted:

(a), in the first control mode, to turn the switching element on and off at a switching frequency and an On time so that a current flows through the inductor in continuous mode without a time interval during which value of the current is zero;

(b), in the second control mode, to change the On time of the switching element while maintaining the switching frequency of the switching element fixed; and (c), in the third control mode, to change the switching frequency of the switching element while maintaining the On time of the switching element fixed, wherein the control circuit operates in the second control mode at least for a first dimming interval in a dimming range between a dimmer setting corresponding to a minimum brightness level of the light source load and a dimmer setting corresponding to a maximum brightness level of the light source load, wherein the control circuit operates in the third control mode at least for a second dimming interval, different from the first dimming interval, in the dimming range between the dimmer setting corresponding to the minimum brightness level of the light source load and the dimmer setting corresponding to the maximum brightness level of the light source load, and wherein the control circuit is adapted:

(i), if the dimming signal corresponds to the dimmer setting corresponding to the maximum brightness level of the light source load, to operate in the first control mode to light the light source load to the maximum brightness level of the light source load; and (ii), if the dimming signal corresponds to a dimmer setting between the dimmer setting corresponding to a minimum brightness level of the light source load and the dimmer setting corresponding to a maximum brightness level of the light source load, to operate in one of the second and third control modes , the control circuit operating in the second control mode when the dimming signal corresponds to a dimmer setting in the second dimming interval and the control circuit operating in the third control mode when the dimming signal corresponds to a dimmer setting in the second dimming interval.

2. The lighting apparatus according to claim 1, further comprises:

a current sensing unit for sensing the current flowing through the switching element; and a capacitor configured to be charged by a driving signal of the switching element, wherein the control circuit is configured:

to turn the switching element off when the current sensed by the current sensing unit reaches a first value; and to turn the switching element on when a value of a voltage across the capacitor is a threshold value or less, and wherein the control circuit comprises:

a multiplying circuit configured to change the first value according to the dimming signal, thereby changing the On time of the switching element; and a switch element configured to change a second value determining a discharge speed of the capacitor according to the dimming signal, thereby changing the switching frequency of the switching element.

3. The lighting apparatus according to claim 2, wherein the control circuit is configured so that the multiplying circuit and the switch element set at least one of the first and second values to be zero or less, thereby, stopping the On and Off operation of the switching element to turn the light source load off.

4. The lighting apparatus according to claim 1, wherein the control circuit is adapted to receive the dimming signal from a dimmer external to the lighting apparatus.

5. The lighting apparatus according to claim 2, wherein the control circuit is adapted to receive the dimming signal from a dimmer external to the lighting apparatus.

6. The lighting apparatus according to claim 3, wherein the control circuit is adapted to receive the dimming signal from a dimmer external to the lighting apparatus.

7. The lighting apparatus according to claim 1, wherein the control circuit is adapted to control the switching element to set the switching frequency of the switching element to be in a range of 1 kHz or more.

8. An illuminating fixture comprising:

the lighting apparatus according to claim 1; and the light source load connected to the lighting apparatus thereby receiving power supplied by the lighting apparatus.

* * * * *